US010724410B1

(12) United States Patent
Waisanen

(10) Patent No.: US 10,724,410 B1
(45) Date of Patent: Jul. 28, 2020

(54) EXHAUST SOUND ENHANCEMENT ASSEMBLY AND METHOD FOR A MARINE PROPULSION DEVICE

(71) Applicant: Brunswick Corporation, Mettawa, IL (US)

(72) Inventor: Andrew S. Waisanen, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 340 days.

(21) Appl. No.: 15/812,265

(22) Filed: Nov. 14, 2017

(51) Int. Cl.

| | |
|---|---|
| ***F01N 1/16*** | (2006.01) |
| ***B63H 20/24*** | (2006.01) |
| ***F01N 13/08*** | (2010.01) |
| ***F01N 13/00*** | (2010.01) |

(52) U.S. Cl.
CPC ..... *F01N 1/166* (2013.01); *B63H 20/24* (2013.01); *F01N 13/004* (2013.01); *F01N 13/08* (2013.01)

(58) Field of Classification Search
CPC ..... F01N 13/08; F01N 13/004; F01N 1/166; B63H 20/24
USPC ..... 181/241
See application file for complete search history.

(56) References Cited

U.S. PATENT DOCUMENTS

| | | | |
|---|---|---|---|
| 1,824,737 | A | 9/1931 | Johnson et al. |
| 3,967,446 | A | 7/1976 | Harralson et al. |
| 4,522,602 | A | 6/1985 | Okazaki |
| 4,601,666 | A | 7/1986 | Wood |
| 4,668,199 | A | 5/1987 | Freund et al. |
| 4,734,070 | A | 3/1988 | Mondek |
| 4,778,029 | A | 10/1988 | Thornburgh |
| 4,846,300 | A | 7/1989 | Boda |
| 4,887,692 | A | 12/1989 | Outani et al. |
| 4,952,182 | A | 8/1990 | Curtis et al. |

(Continued)

FOREIGN PATENT DOCUMENTS

| | | | |
|---|---|---|---|
| EP | 1358400 | A1 | 11/2003 |
| JP | 2006069277 | A | 3/2006 |

OTHER PUBLICATIONS

K.C. Colwell, Faking It: Engine-Sound Enhancement Explained, Car and Driver Website, Apr. 2012, available at http://www.caranddriver.com/features/faking-it-engine-sound-enhancement-explained-tech-dept, 7 pages.

(Continued)

*Primary Examiner* — Forrest M Phillips
(74) *Attorney, Agent, or Firm* — Andrus Intellectual Property Law, LLP

(57) ABSTRACT

A marine propulsion device includes an internal combustion engine powering the marine propulsion device and an engine compartment containing the engine. A primary exhaust passageway routes exhaust gas away from the engine and out of the engine compartment. A sound enhancement assembly communicates with the primary exhaust passageway. The sound enhancement assembly includes a sound enhancement device tuned to amplify exhaust sounds of a predetermined frequency and a sound duct downstream of the sound enhancement device that transmits the amplified exhaust sounds to an area outside the engine compartment. The sound enhancement device isolates the sound duct from the exhaust gas. A method for modifying sounds produced by an exhaust system of the internal combustion engine is also disclosed.

20 Claims, 7 Drawing Sheets

(56) References Cited

U.S. PATENT DOCUMENTS 5,083,538 A 1/1992 Hubbell
5,348,500 A 9/1994 Lassanske
5,954,554 A 9/1999 Bates
6,299,496 B1 * 10/2001 Griffiths ..... B63H 21/32 440/1
6,647,956 B1 11/2003 Sharpton
6,722,467 B1 4/2004 Kusche et al.
6,732,509 B2 5/2004 Shiga
6,830,024 B2 12/2004 Kodweiss et al.
6,932,189 B2 8/2005 Helber et al.
7,021,262 B1 4/2006 Belter et al.
7,188,703 B2 3/2007 Hofmann et al.
7,299,783 B1 11/2007 Broman et al.
7,350,496 B2 4/2008 Nakayama et al.
7,353,791 B2 * 4/2008 Sasaki ..... F02M 35/10019 123/184.53
7,448,353 B2 11/2008 Shinada et al.
7,506,626 B2 3/2009 Sasaki et al.
7,621,370 B2 11/2009 Abe et al.
7,845,466 B2 12/2010 Kostun et al.
RE42,490 E 6/2011 Takeuchi et al.
7,967,106 B2 6/2011 Ross et al.
8,011,469 B2 9/2011 Olson
8,127,888 B1 3/2012 Mah
8,322,486 B2 12/2012 Ohta et al.
8,384,528 B2 * 2/2013 McCarthy ..... H04S 7/00 123/184.21
8,579,077 B2 11/2013 Ahn et al.
8,651,906 B1 2/2014 Morton
8,666,088 B2 3/2014 Khami et al.
8,684,132 B2 4/2014 Muller et al.
8,776,755 B2 7/2014 Muller et al.
8,876,566 B1 11/2014 Hilbert et al.
8,905,187 B2 12/2014 Schorn et al.
9,025,786 B2 5/2015 Luecking et al.
9,051,041 B2 6/2015 Litjens et al.
9,359,981 B1 * 6/2016 Waisanen ..... F02M 35/167
9,365,273 B2 6/2016 Davis et al.
9,376,191 B1 6/2016 Jaszewski
9,376,194 B1 * 6/2016 Jensen ..... B63H 20/245
9,376,195 B1 6/2016 Jaszewski et al.
9,386,366 B2 7/2016 Koch et al.
9,422,843 B2 8/2016 Barrett et al.
9,429,117 B2 8/2016 Takahashi et al.
9,462,363 B2 10/2016 Wirth et al.
9,677,438 B2 * 6/2017 Holbrook ..... F01N 1/16
2005/0121254 A1 * 6/2005 Hofmann ..... F01N 13/00 181/237
2005/0121255 A1 6/2005 Hofmann
2005/0133300 A1 * 6/2005 Hofmann ..... G10K 11/22 181/250
2007/0054569 A1 3/2007 Murai et al.
2007/0261387 A1 11/2007 Maybeck
2007/0292281 A1 12/2007 Sasaki et al.
2009/0078497 A1 3/2009 Ishizuka et al.
2011/0147116 A1 * 6/2011 Olson ..... F02M 35/1272 181/204
2014/0055258 A1 2/2014 Grosse-Budde
2017/0350287 A1 * 12/2017 Pompucci ..... F01N 13/04

OTHER PUBLICATIONS

Waisanen et al., Outboard Motor With Sound Enhancement Device and Method for Modifying Sounds Produced by Air Intake System of an Outboard Motor, Unpublished U.S. Appl. No. 15/091,007, filed Apr. 5, 2016.
Waisanen et al., "Actively Tunable Exhaust Systems for Outboard Marine Engines," Unpublished U.S. Appl. No. 15/088,656, filed Apr. 1, 2016.
Waisanen et al., "Outboard Motor With Sound Enhancement Device and Method for Modifying Sounds Produced by Air Intake System of an Outboard Motor," Unpublished U.S. Appl. No. 15/219,617, filed Jul. 26, 2016.

* cited by examiner

EXHAUST SOUND ENHANCEMENT ASSEMBLY AND METHOD FOR A MARINE PROPULSION DEVICE

FIELD

The present disclosure relates to exhaust systems for internal combustion engines associated with marine propulsion devices.

BACKGROUND

U.S. Pat. No. 9,359,981 discloses an outboard motor including a system for enhancement of a first subset of sounds having a desired frequency, and a method for modifying sounds produced by an air intake system for an internal combustion engine powering the outboard motor. The method includes collecting sounds emitted in an area proximate a throttle body of the engine. A first subset of the collected sounds, which have frequencies within desired frequency range, is then amplified. The amplified first subset of sounds is then transmitted to an area outside a cowl covering the engine.

U.S. Pat. No. 9,376,195 discloses an outboard motor comprising an engine having an exhaust gas discharge opening, a midsection housing coupled below and supporting the engine, and an exhaust pipe having an exhaust inlet in fluid communication with the exhaust gas discharge opening. The exhaust pipe extends downwardly to a primary exhaust outlet. An idle relief port in the exhaust pipe is located in a fluid path between the exhaust inlet and the primary exhaust outlet. A sound-attenuating plenum chamber has an interior that is in fluid communication with an interior of the exhaust pipe by way of the idle relief port. The plenum chamber is a separate component that is exterior to the midsection housing, and exhaust gas flows from the interior of the exhaust pipe to the interior of the plenum chamber without first flowing through the midsection housing.

U.S. Pat. No. 9,944,376 discloses exhaust systems for outboard marine engines that are configured to propel a marine vessel in a body of water. An intermediate exhaust conduit is configured to receive the exhaust gas from the primary exhaust conduit. A primary muffler receives the exhaust gas from a intermediate exhaust conduit. A secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

U.S. Pat. No. 10,180,121 discloses an outboard motor including an internal combustion engine and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided, and has an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified sounds to an area outside the cowl. A method for modifying sounds produced by an air intake system of an outboard motor is also provided.

U.S. Pat. No. 9,909,545 discloses an outboard motor including an internal combustion engine powering the outboard motor and a cowl covering the engine and having a vent allowing air under the cowl. A throttle body meters flow of the air into the engine and an intake structure downstream of the throttle body delivers the metered airflow to one or more combustion chambers in a cylinder block of the engine. A sound enhancement assembly in acoustic communication with the intake structure collects sounds emitted by the engine. The sound enhancement assembly is configured to amplify a subset of the collected sounds that have frequencies within a desired frequency range. A method for modifying sounds produced by an air intake system of an internal combustion engine powering an outboard motor is also disclosed. The method includes positioning a sound enhancement assembly in acoustic communication with an air intake passageway located downstream of the engine's throttle body.

The above patents and patent applications are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure includes a marine propulsion device comprising an internal combustion engine powering the marine propulsion device and an engine compartment containing the engine. A primary exhaust passageway routes exhaust gas away from the engine and out of the engine compartment. A sound enhancement assembly communicates with the primary exhaust passageway. The sound enhancement assembly includes a sound enhancement device tuned to amplify exhaust sounds of a predetermined frequency and a sound duct downstream of the sound enhancement device that transmits the amplified exhaust sounds to an area outside the engine compartment. The sound enhancement device isolates the sound duct from the exhaust gas.

According to another example of the present disclosure, a method for modifying sounds produced by an exhaust system of an internal combustion engine powering a marine propulsion device is disclosed. The method comprises providing a sound enhancement device proximate a primary exhaust passageway that routes exhaust gas away from the engine; routing the exhaust gas from the primary exhaust passageway to the sound enhancement device; and configuring the sound enhancement device to amplify exhaust sounds of a predetermined frequency. The method also includes routing a sound duct from the sound enhancement device to an area outside an engine compartment containing the engine such that the amplified exhaust sounds can be transmitted as sound pressure pulses through the sound duct to the area outside the engine compartment. The method also includes preventing the exhaust gas from flowing through the sound duct.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
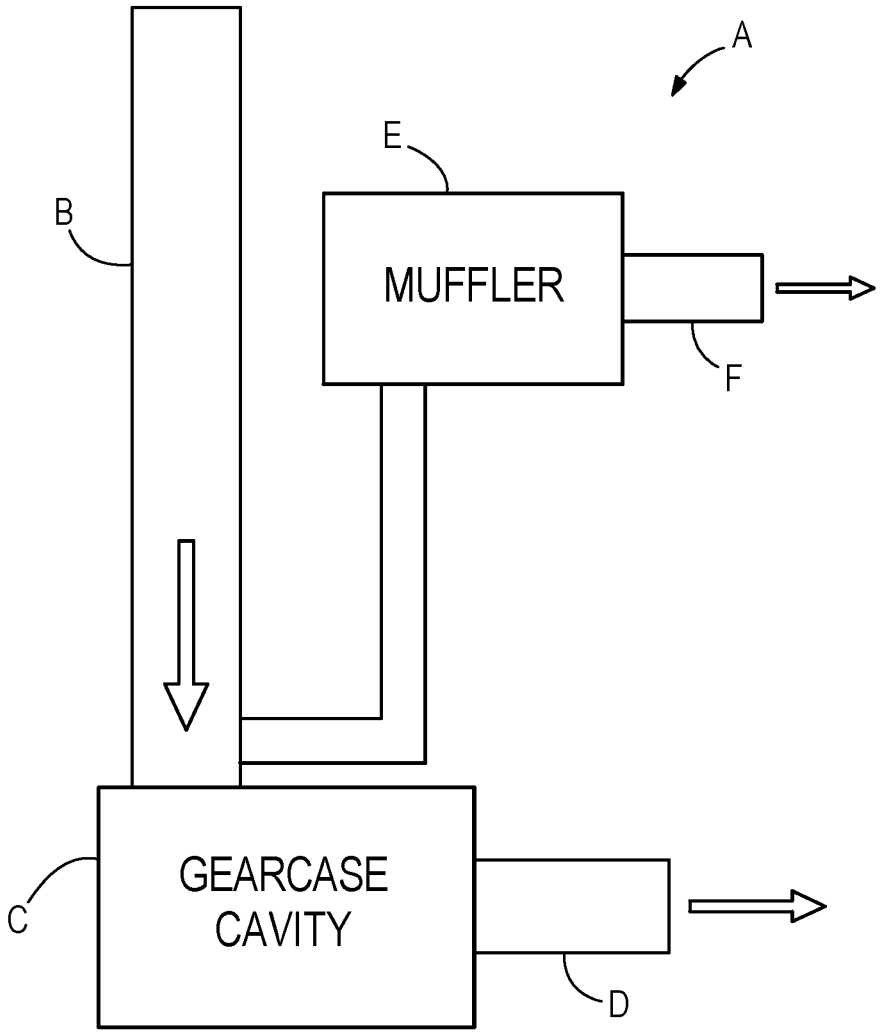
FIG. 1 PRIOR ART
FIG. 1 is a schematic view of a prior art exhaust system for a marine propulsion device's engine.

FIG. 1 depicts a conventional exhaust system A for a marine propulsion device, such as an outboard motor or a stern drive. Hot, dry exhaust gas is conveyed from an internal combustion engine via an exhaust pipe B, where it is cooled by water from sprayers. The exhaust gas is then conveyed to a lower gearcase cavity C, wherein the exhaust gas is allowed to expand. When the internal combustion engine is operated at above-idle speeds, most or all of the exhaust gas is discharged via an underwater outlet D, which typically is formed through the gearcase and an associated propeller assembly. When the internal combustion engine is operated at idle speed, the pressure associated with the body of water in which the propeller assembly is situated typically prevents a significant flow of the exhaust gas through the underwater outlet D. Most or all of the exhaust gas tends to take a path of least resistance to the atmosphere, which is through an idle relief muffler E and then through an idle relief outlet F. The idle relief outlet F is located above the body of water in which the marine propulsion device is situated, and is generally directed away from the marine vessel (and thus operator), as it is not desirable to direct exhaust gas toward those on the vessel.

Product noise requirements and/or expectations of a given marine propulsion device can vary greatly depending on the application. For example, performance boaters may desire a louder and/or more powerful exhaust sound quality than recreational boaters. However, expectations for sound quality and refinement are universal, and dictated in some geographical areas by law, regardless of the noise level expectations of the customer. The system and method of the present disclosure enhance the powerful, desirable sound characteristics of a marine propulsion device without sacrificing the requirements and/or expectations for refinement of unpleasant sound. For example, because at above-idle engine speeds exhaust sounds are usually muffled as they pass through the gearcase cavity C and underwater outlet D, the present inventors have developed a system and method for amplifying exhaust sounds in a controllable manner at mid to high engine speeds, with minimal impact on engine performance. The present inventors have also developed a system and method that allow for tuned amplification of exhaust sounds when the engine is at idle or near-idle speeds, in contrast to the muffled system shown in FIG. 1.

The present inventors have determined through research and development that conventional exhaust systems for marine propulsion devices do not adequately allow an operator to actively tune the sound emanating from the exhaust system A. More specifically, the present inventors have determined that it would be desirable to provide actively tunable exhaust systems for marine propulsion devices, wherein the operator is given the ability to select between a variety of exhaust sounds and to amplify the selected sounds. The present disclosure is a result of the inventors' research and experimentation directed towards providing the operator of a marine propulsion device with the ability to select a particular sound quality of the exhaust system. By way of the present system and method, an operator is able to increase the exhaust noise contribution throughout the entire engine speed range, rather than suppress it during idle/low speed operation as does a muffler E in a traditional idle relief circuit.

Figure 2:
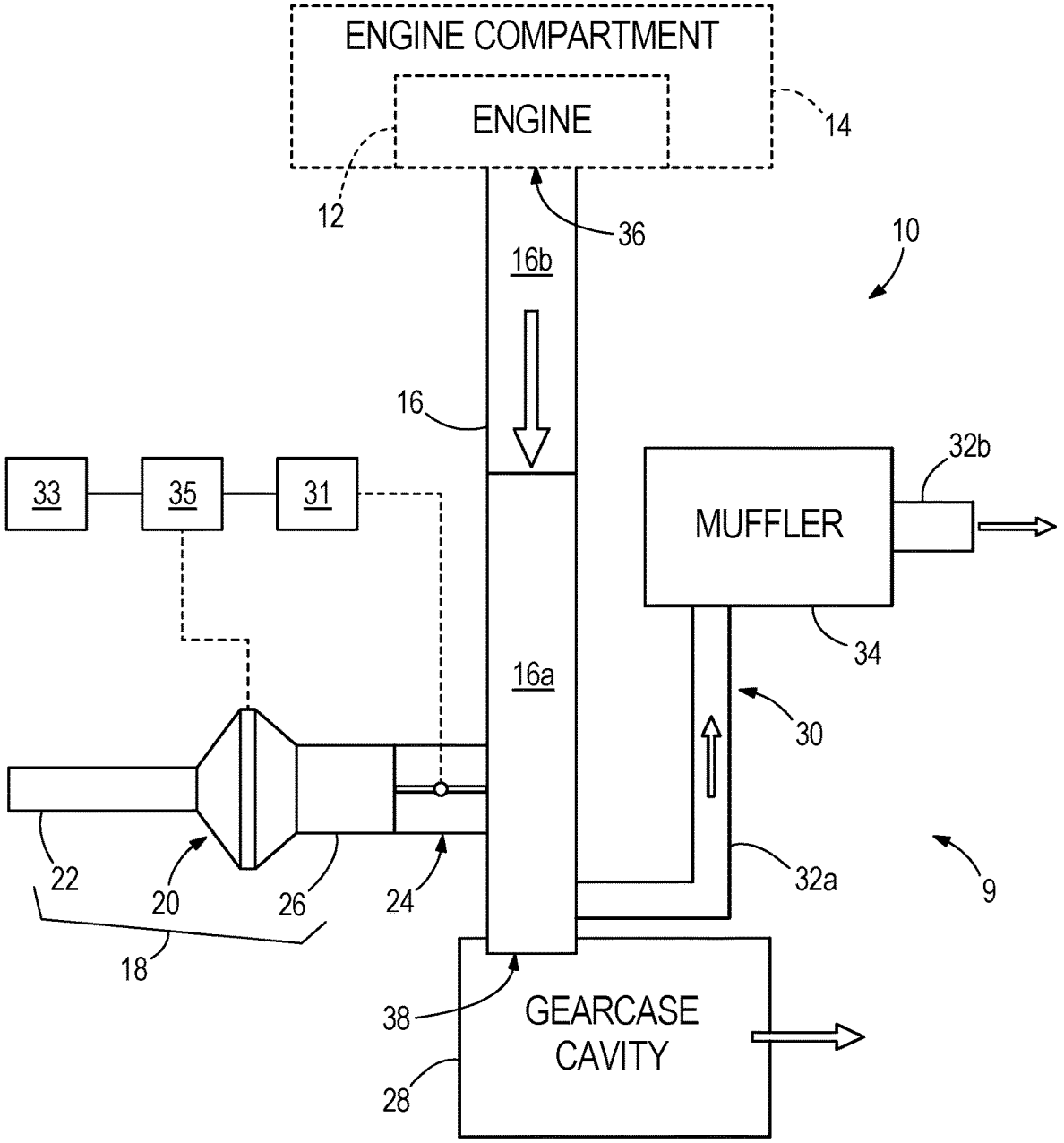
FIG. 2 is a schematic view of a marine propulsion device having an exhaust system and an exhaust sound enhancement assembly according to the present disclosure.

FIG. 2 is a simplified schematic illustrating one example of the present disclosure, which includes a marine propulsion device 10 comprising an internal combustion engine 12 powering the marine propulsion device 10 and an engine compartment 14 containing the engine 12. A primary exhaust passageway 16 has an upstream end 36 via which the primary exhaust passageway 16 routes exhaust gas away from the engine 12 and out of the engine compartment 14. The engine compartment 14 can be an upper cowl in the case where the marine propulsion device 10 is an outboard motor, or a compartment in the hull of the marine vessel in the case where the marine propulsion device 10 is a stern drive. Thus, the relative vertical orientation of the engine 12 and primary exhaust passageway 16 and the locations and relative sizes of the engine 12 and engine compartment 14 shown here are for exemplary purposes only. Similar to the exhaust system A of FIG. 1, the exhaust system 9 for the marine propulsion device 10 of FIG. 2 also includes a gearcase cavity 28 through which exhaust gas discharged from a downstream end 38 of the primary exhaust passageway 16 flows when the engine 12 is operating at above-idle speeds. When the engine is operating at near-idle or idle speeds, the exhaust gas instead flows through an idle relief assembly 30 communicating with the primary exhaust passageway 16. The idle relief assembly 30 comprises an idle relief passageway 32*a*, an idle relief muffler 34, and an idle relief outlet 32*b*.

A sound enhancement assembly 18 communicates with the primary exhaust passageway 16. The sound enhancement assembly 18 includes a sound enhancement device 20 tuned to amplify exhaust sounds of a predetermined frequency, as will be described further herein below. The sound enhancement assembly 18 also includes a sound duct 22 downstream of the sound enhancement device 20 that transmits the amplified exhaust sounds to an area outside the engine compartment 14, such as outside the cowl for an outboard or outside the hull for a stern drive. The sound enhancement device 20 isolates the sound duct 22 from the exhaust gas in the primary exhaust passageway 16, as will also be described further herein below. A sound control valve 24 upstream of the sound enhancement device 20 controls provision of the exhaust gas to the sound enhancement device 20. In one example, the sound control valve 24 is a butterfly valve, as shown here. The sound enhancement assembly 18 also includes a drive pipe 26 that connects the sound control valve 24 to the sound enhancement device 20. In this example, the sound control valve 24 is connected directly to the primary exhaust passageway 16.

More specifically, the sound enhancement assembly 18 communicates via the sound control valve 24 with a lower portion 16*a* of the primary exhaust passageway 16 that carries exhaust gas that has been cooled by cooling water, which is sprayed into the primary exhaust passageway 16 itself and/or surrounds the primary exhaust passageway 16 in a water jacket. The exhaust gas in the lower portion 16*a* is sometimes referred to as "cooled" or "wet" exhaust, in contrast to the "hot" or "dry" exhaust present in an upper portion 16*b* of the primary exhaust passageway 16. Note that although the former may be called "wet" exhaust, the inlet to the sound enhancement assembly 18 may be placed in a location where the exhaust that enters it does not actually have water droplets in it, in order to maintain the structural and functional integrity of the sound enhancement assembly 18.

Figure 3:
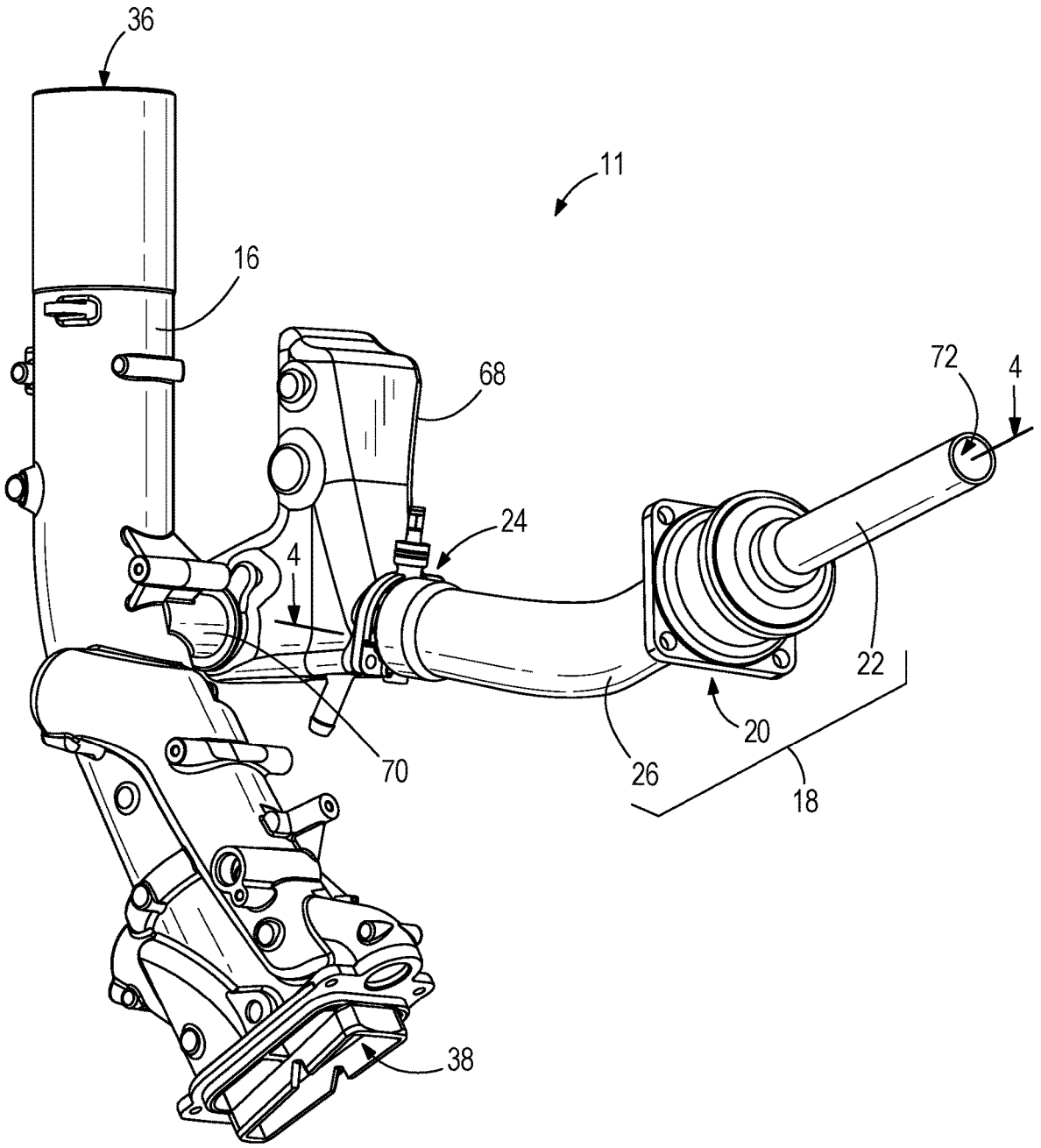
FIGS. 3 and 4 illustrate portions of another embodiment of an exhaust system and an exhaust sound enhancement assembly according to the present disclosure.
Figure 4:
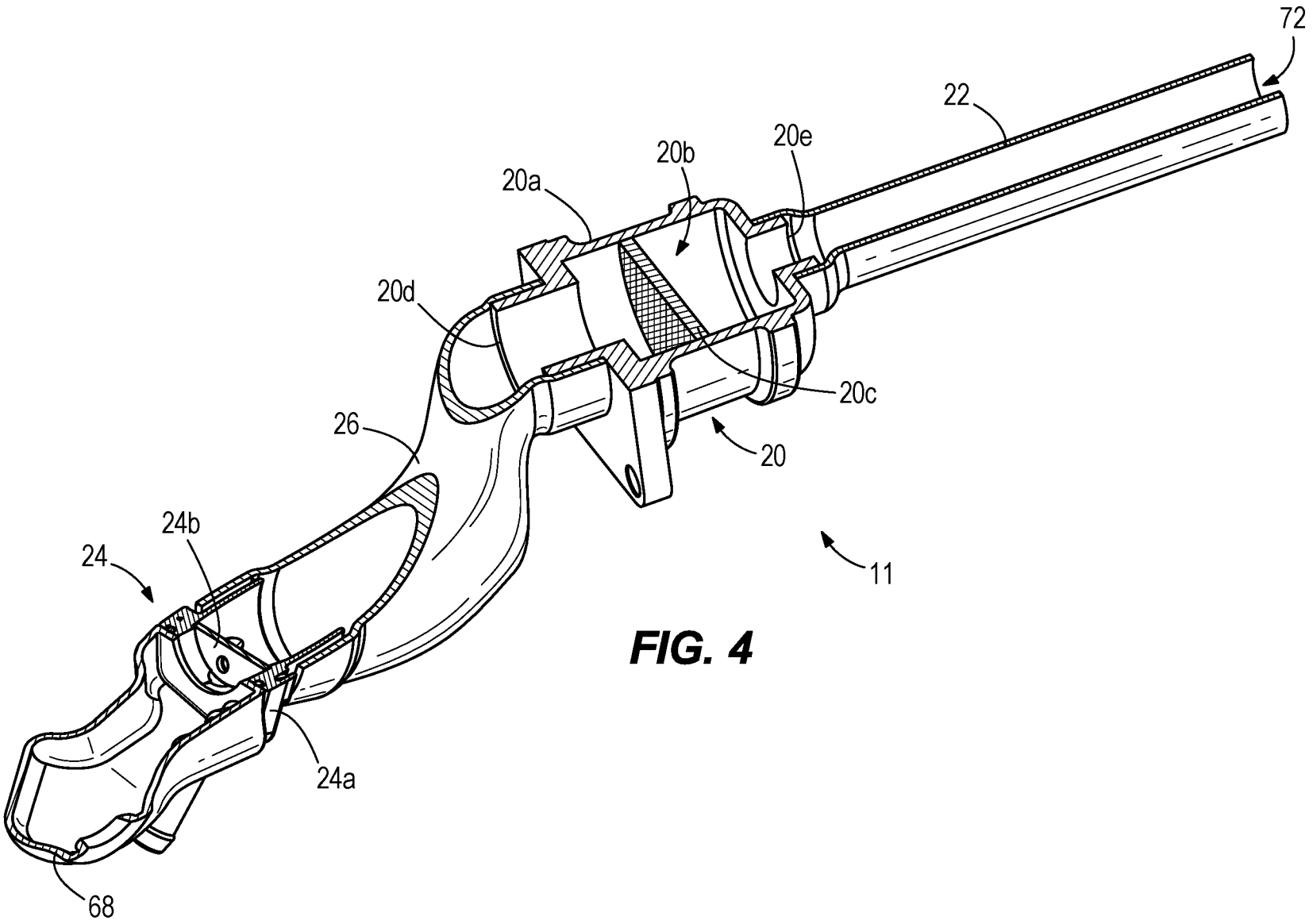

FIG. 3 illustrates another example of a portion of an exhaust system 11 for a marine propulsion device 10. Like components have been labeled with like reference numbers and will not be described again. Note that the engine and engine compartment are not shown in these figures, but that the primary exhaust passageway 16 shown is configured to accept exhaust gas from the engine at its upstream end 36 and to discharge the exhaust gas via its downstream end 38 to a body of water via a gearcase cavity. The exhaust system 11 is similar to that of FIG. 2, in that the sound enhancement assembly 18 communicates with the primary exhaust passageway 16 by way of the sound control valve 24. However, in this example, the sound enhancement assembly 18 is located downstream of a muffler 68, which is connected to the primary exhaust passageway 16 by way of an inlet pipe 70. The drive pipe 26 of the sound enhancement assembly 18 is connected to an outlet of the muffler 68 by way of the sound control valve 24. FIG. 4 is a partial cross-sectional view showing how the sound control valve 24 includes a valve body 24*a* and a valve plate 24*b*. The valve body 24*a* is bolted to the muffler 68 and has a downstream end that fits into an upstream end of the drive pipe 26. The sound enhancement device 20 includes a membrane housing 20*a* coupling the sound duct 22 to the primary exhaust passageway 16. In this example, such coupling is made by way of the membrane housing 20*a* having an upstream end that fits into the drive pipe 26, and by way of sound control valve 24, muffler 68, and inlet pipe 70. Note that the muffler 68 and inlet pipe 70 do not need to be provided in alternative examples, such as that of FIG. 2. In fact, in all examples described herein, the sound control valve 24 is also optional.

As shown, the membrane housing 20*a* has an open interior 20*b*, which in this example is cylindrical. A flexible membrane 20*c* extends transversely across the open interior 20*b* of the membrane housing 20*a* and isolates the sound duct 22 from the exhaust gas in the drive pipe 26. The sound enhancement device 20 is tuned to amplify exhaust sounds of a predetermined desired frequency that are caused by pulsations of exhaust gas within the exhaust system 11. The sound duct 22 transmits the amplified exhaust sounds to an area outside the engine compartment 14. The sound duct 22 can be made of plastic or another material that is suitable for a marine environment. The sound duct 22 can have a cross-sectional shape of a circle (as shown), an oval, a rectangle, or another type of polygon, according to the desired sound effect and design constraints imposed by the remainder of the marine propulsion device 10. Several different characteristics, structures, and designs for the sound duct 22 are available. For instance, the shape and diameter of the sound duct 22 can be selected specifically to achieve desired enhancement of sound.

The sound enhancement device 20 acts as a passive speaker that is tuned to amplify exhaust sounds of the predetermined frequency. The sound enhancement device 20 adjusts the spectral frequency (sound amplitude vs. frequency) of sounds having the predetermined frequency without the use of active components such as, for example, electronic amplifiers. This predetermined frequency can be defined in any way desired by the manufacturer, installer, or operator of the marine propulsion device 10. For example, the predetermined frequency may include sounds that produce what might be considered a pleasant "rumble" that conveys the power of the engine 12 to the operator of the vessel. The sound enhancement device 20 can be tuned to amplify this pleasant rumble such that the operator can hear it better. Of note is that the primary exhaust passageway 16 is separate and distinct from the passageway defined by the sound duct 22. The primary exhaust passageway 16 conducts exhaust gas, while the sound duct 22 conducts sound pressure pulses to the area outside the engine compartment 14. The sound enhancement device 20 separates these two passageways from one another, and does not allow air to pass between the two passageways. Rather, it is sound that is transmitted by the sound duct 22. Thus, the sound enhancement assembly 18 can be provided as an add-on or aftermarket feature that does not affect or interfere with the primary exhaust flow. The present arrangement is therefore different from a through-cowl (for an outboard) or through-hull (for a stern drive) exhaust system, in that exhaust sounds can be provided to the atmosphere without exhaust gas also being provided to the atmosphere.

In one example, the sound enhancement device 20 comprises the membrane 20*c* that extends generally transversely across the open interior 20*b* of the membrane housing 20*a*. In another example, the membrane 20*c* can extend across an aperture within a single pipe that defines both the drive pipe 26 and the sound duct 22. The membrane 20*c* can have any sort of shape that will fill the cross-sectional shape of the membrane housing 20*a*, and its outer edges can be sealed along an inner perimeter of the open interior 20*b* so as to isolate the sound duct 22 from contact with exhaust gas. Thus, as noted, the sound duct 22 is not a functional part of the exhaust system 11 and does not supply exhaust to the atmosphere. Retaining rings can be provided on one or both sides of the membrane 20*c* to hold it within the open interior 20*b*, which can be provided with an inner flange to hold the retaining rings.

The membrane 20*c* may be made out of any sort of flexible or elastomeric substance, and in one example is a disc made out of rubber. A stiffness of the membrane 20*c* can be changed (tuned) in order to provide a desired amount of amplification of sounds having the predetermined frequency and/or to change the frequency of sounds that will be amplified. The stiffness of the membrane 20*c* can be varied by stretching the membrane 20*c* tighter or allowing the membrane 20*c* to be looser as it spans the open interior 20*b*. Another way in which the acoustic flexure properties of the membrane 20*c* may be tuned or adjusted is by varying the thickness (and therefore mass and stiffness) of the membrane 20*c*. Additionally, the composition of the membrane 20*c* itself and/or products that are applied to the membrane 20*c* can cause it to exhibit different characteristics upon application of sound waves. Because the sound enhancement assembly 18 (including drive pipe 26, sound duct 22, and sound enhancement device 20) is passive, it relies on acoustic excitation of components of the sound enhancement device 20 by exhaust sounds to provide amplification. As noted above, the inlet to the sound enhancement assembly 18 may be along the path of cooled exhaust; this prevents the membrane 21*c* from being compromised by heat, which is helpful in the instance where the membrane 21*c* is made from rubber.

In alternative embodiments, the sound enhancement device 20 includes a membrane 21*c* made of plastic or of a thin metal sheet attached to a spring that can be tuned (by selection of the spring or by adjusting the spring constant by way of an electrical current from a controller 35, as will be described herein below) to achieve amplification of exhaust sounds having the desired predetermined frequency. The sound enhancement device 20 may have components alternative to the membrane 21*c*, such as a trumpet or a flexible bellows with an end cap.

An outlet end 72 of the sound duct 22 is located outside of the engine compartment 14, such as outside the chaps (lower cowl) on a fore side of an outboard motor, or outside the vessel hull for a stern drive, so as to deliver the amplified exhaust sounds to an area that is closest to the operator. In one example, the entire sound enhancement assembly 18 except for the outlet end 72 is placed underneath the chaps (lower cowl) of an outboard motor, thus hiding it from view and also avoiding packaging/space conflicts with powerhead components in the upper cowl area. In contrast, exhaust gas exiting the idle relief outlet 52 can be directed to a side or the rear of the marine propulsion device 10, as an operator would not want exhaust gas emitted in his/her direction. Non-amplified exhaust sounds, which have frequencies other than within the predetermined frequency range, will also be emitted via the idle relief outlet 52. In fact, in the instance where an idle relief muffler 34 is included (see FIG. 2), these non-amplified sounds will be muffled. Thus, the operator can better hear the amplified, desirable sounds than he or she can hear the non-amplified and/or muffled remainder of the sounds.

As alluded to, the exhaust systems 9, 11 (and 13, 15, FIGS. 5-8) shown herein can also be designed to attenuate exhaust sounds of different predetermined frequencies that are within an undesired frequency range. For example, these may be sounds having a frequency that might be considered annoying to the operator of the marine propulsion device 10. In order to attenuate these undesirable sounds, the length and/or shape of the sound duct 22 can be selected specifically to provide a desired amount of attenuation. Alternatively or additionally, a stiffness of the membrane 20*c* of the sound enhancement device 20 can be tuned to provide a desired amount of attenuation of the undesired sounds. Additionally or alternatively, a sound attenuating device may be provided within the sound duct 22 so as to provide a desired amount of attenuation of the undesired sounds. The sound attenuating device could be a small fibrous pad, another type of padded material, or a similar spongey-type material that is designed to attenuate certain frequencies of sounds. The mufflers described herein above and below also attenuate sounds created by the flow of exhaust gas. Therefore, the systems described herein provide enhancement of desirable engine sound characteristics, while minimizing unwanted sounds. By suppressing unwanted sounds and highlighting desirable sounds, a more refined sound quality can be obtained.

Figure 6:
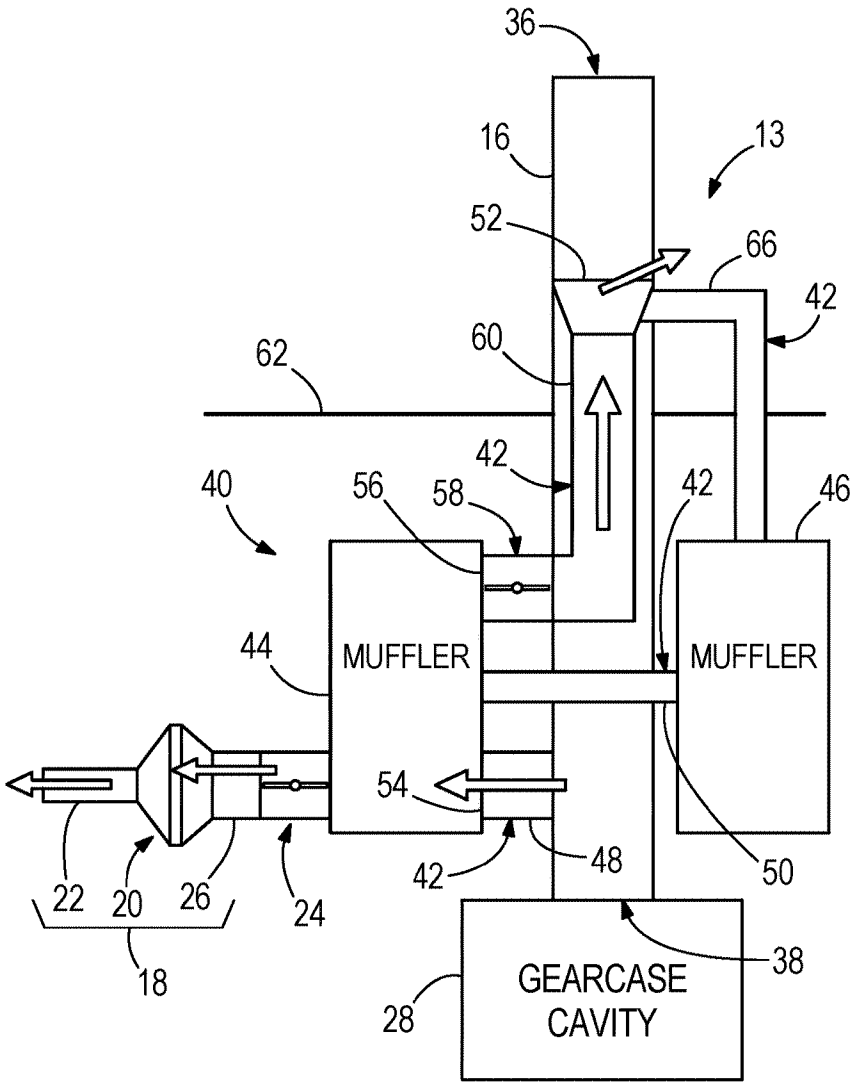
FIGS. 5 and 6 illustrate another embodiment of an exhaust system and an exhaust sound enhancement assembly according to the present disclosure.
Figure 5:
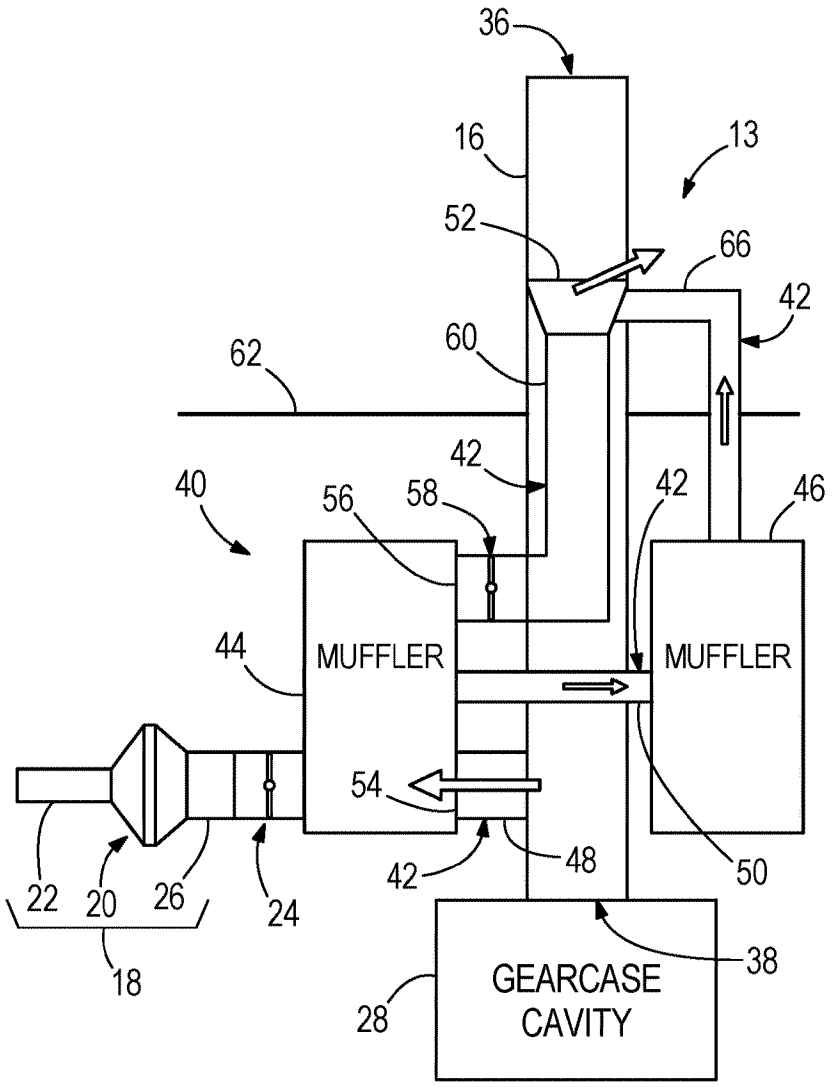
Figure 8:
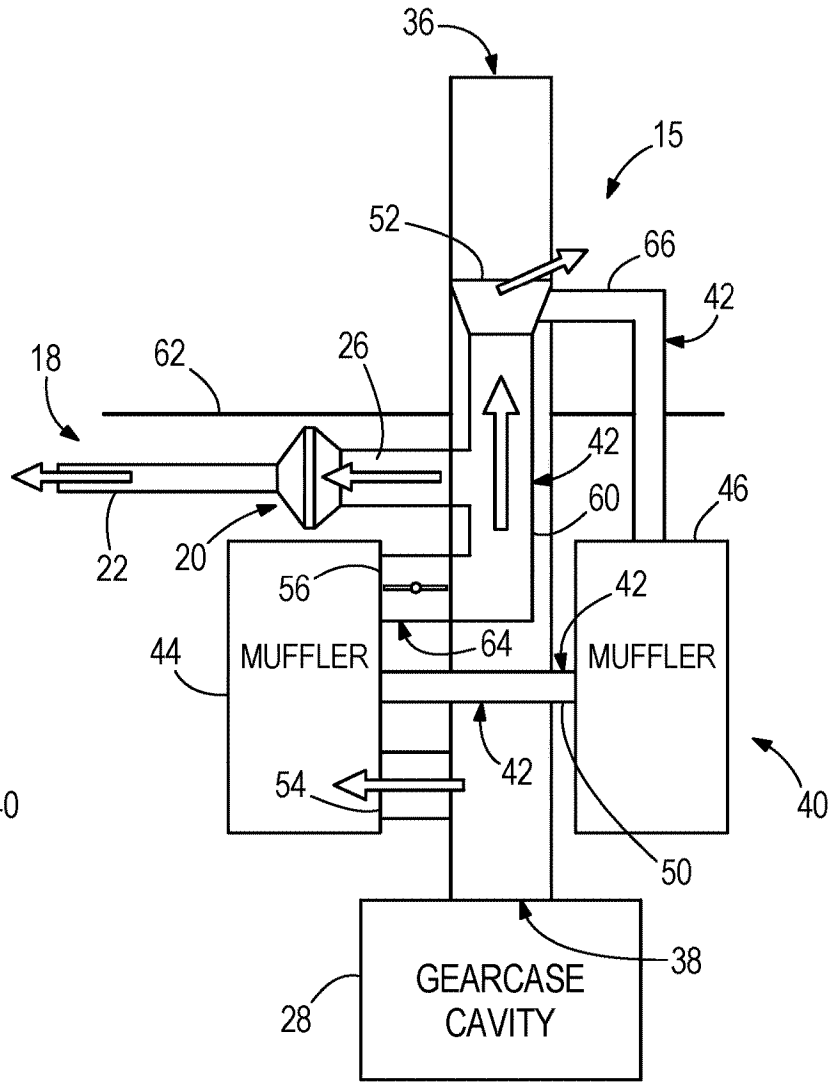
FIGS. 7 and 8 illustrate another embodiment of an exhaust system and an exhaust sound enhancement assembly according to the present disclosure.
Figure 7:
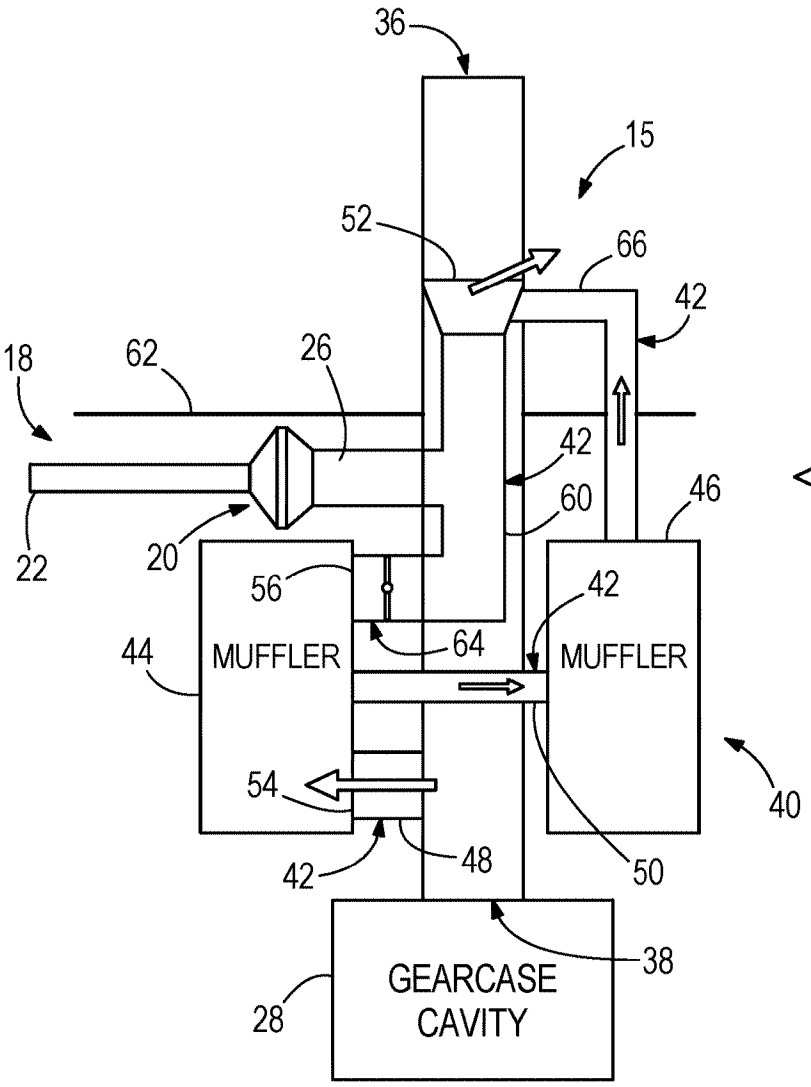

Note that components of the sound enhancement assembly 18 described with respect to FIGS. 3 and 4 can be used in the exhaust system 9 of FIG. 2 as well as in the exhaust system 13 of FIGS. 5 and 6 and the exhaust system 15 of FIGS. 7 and 8. Note also that the operator input device 31, controller 35, and indicator device 33 about to be described with respect to FIG. 2 are usable with the exhaust system 11 of FIGS. 3 and 4, as well as with the exhaust systems 13 and 15 of FIGS. 5-8. However, details of those components that are the same in each system will not be described repetitively for the sake of brevity.

Returning to FIG. 2, in some examples, an operator input device 31 is provided via which an operator can control the sound control valve 24. For example, the operator input device 31 is mechanically and/or electrically and/or otherwise communicatively coupled to and configured to control the sound control valve 24. The operator input device 31 is configured to allow an operator to selectively position the sound control valve 24 into and out of open and closed positions, and optionally intermediate position(s), which facilitate tuning of the amount of exhaust sound amplification by allowing more or less exhaust gas (and therefore pressure pulses) to enter the sound enhancement device 20. The type and configuration of the operator input device 31 can vary, and the manner in which the operator input device 31 is connected to the sound control valve 24 can vary. In certain non-limiting examples, the operator input device 31 can include one or more mechanical levers, and/or computer keypads, and/or touch screens and/or the like. The operator input device 31 can be configured to directly communicate with and control the position of the sound control valve 24 via, for example, a mechanical link or an electronically wired or wireless communication link, an example of which is schematically shown in the drawings. In other examples, the operator input device 31 can be configured to communicate an operator input to a computer controller 35, such as an engine control unit (ECU) that is configured to electronically control the sound control valve 24.

In other examples, instead of including a sound control valve 24, the sound enhancement assembly 18 may include a moveable contact member supported by and within the membrane housing 20*a*, such as an arm or disc, which can be moved into or out of contact with the membrane 20*c*, thereby limiting or preventing or allowing movement of the membrane 20*c*, respectively. When the contact member is in contact with the membrane 20*c*, movement or elastic deformation (and hence amplification of sound) is limited or prevented. This feature provides an alternative way to turn the sound amplification on or off, as the contact member may also be in communication with the operator input device 31 and/or the controller 35.

The noted controller 35 can be programmable and include a processor and a memory. The controller 35 can be located anywhere in the system and/or located remote from the system and can communicate with various components of the marine vessel via wired and/or wireless links. In certain examples, the controller 35 is an engine control unit (ECU) that is also configured to control the internal combustion engine and/or other components of the marine propulsion device 10. Although FIG. 2 schematically shows one controller 35, the system can include more than one controller 35. For example, the system can have a controller 35 located at or near a helm of the marine vessel and can also have one or more controllers located at or near the marine propulsion device 10. Portions of the methods disclosed herein below can be carried out by a single controller or by several separate controllers. Each controller can have one or more control sections or control units. One having ordinary skill in the art will recognize that the controller 35 can have many different forms and is not limited to the example that is shown and described. In some examples, the controller 35 may include a computing system that includes a processing system, storage system, software, and input/output (I/O) interfaces for communicating with devices such as those shown in FIG. 2. The processing system loads and executes software from the storage system. When executed by the computing system, software directs the processing system to operate as described herein below in further detail to execute the methods described herein. The computing system may include one or many application modules and one or more processors, which may be communicatively connected. The processing system can comprise a microprocessor and other circuitry that retrieves and executes software from the storage system. The processing system can be implemented within a single processing device but can also be distributed across multiple processing devices or sub-systems that cooperate in existing program instructions. Non-limiting examples of the processing system include general purpose central processing units, applications specific processors, and logic devices.

The controller 35 can be programmed to automatically tune the sound enhancement device 20 with or without an initial input from the operator input device 31. For example, the controller 35 may open the sound control valve 24 to increasingly more open positions as the speed of the engine 12 or the marine vessel increases. Alternatively, the controller 35 may open the sound control valve 24 only when the engine speed is within a specific RPM range predefined and saved in the memory. In the example in which a contact member is provided for contacting the membrane 21*c*, the controller 35 may move the contact member out of contact with the membrane 21*c* when the engine 12 is operated in the RPM range. In these ways, the sound enhancement device 20 can be designed as an actively tunable device that controls the amount of sound amplification as function of engine and/or vessel speed.

The controller 35 may additionally or alternatively be programmed to change physical characteristics of the sound enhancement device 20 by way of signal communication therewith. The controller 35 can change the device's physical characteristics, for example, as a function of engine or vessel speed or in response to input via the operator input device 31. By way of non-limiting examples, the controller 35 may be in electrical communication with a shape memory alloy wire running through or along the spring in the example in which the sound enhancement device 20 is a spring/mass system, wherein provision of different electrical currents through the wire change the stiffness of the spring and thus the spectral frequency of exhaust sound that will be amplified. In another example, in the example in which the sound enhancement device 20 has a flexible bellows-like housing, the controller 35 may provide a current to a shape memory alloy wire or to a mechanical device that causes the bellows to lengthen or contract, thereby changing the spectral frequency of exhaust sound that will be amplified. Other mechanical or electrical devices may be provided that change the tautness of the membrane 21*c* across the membrane housing 21*a*. In these exemplary ways, not only is tuning of the amount of amplification of the sound enhancement assembly 18 possible by way of the sound control valve 24 and/or contact member, but tuning of the frequency range that will be amplified is also possible.

Optionally, an indicator device 33 can be provided that is configured to indicate to the operator a current position of the sound control valve 24 or contact member. The operator input device 31 and/or indicator device 33 can be located remotely from the marine propulsion device 10, for example at the helm of the marine vessel, or even remotely from the marine vessel. The type of indicator device 33 can vary. In certain non-limiting examples, the indicator device 33 can include a video or touch screen, and/or flashing lights, and/or the like. The indicator device 33 can be electronically controlled by the controller 35 to indicate to the operator the current position of the sound control valve 24 or contact member.

Via the operator input device 31, the exemplary system shown in FIG. 2 advantageously provides the operator of the marine propulsion device 10 with the ability to actively control the quality and characteristics of exhaust sound emanating from the exhaust system. This capability can provide significant advantages in certain settings. For example, performance and/or bass boaters can obtain a louder, more aggressive sound quality by opening the sound control valve 24 and allowing more exhaust gas pressure pulses to be amplified by the sound enhancement device 20. Off-shore fisherman or recreational boaters can obtain a quieter, less aggressive sound quality by closing the sound control valve 24. As noted above, the sound control valve 24 is optional, and the drive pipe 26 could instead be directly connected to the primary exhaust passageway 16.

FIGS. 5 and 6 illustrate another example of an exhaust system 13 of the present disclosure. Note that the engine and engine compartment are again not shown in these figures, but that the primary exhaust passageway 16 shown is configured to accept exhaust gas from the engine at its upstream end 36 and to discharge the exhaust gas either via its downstream end 38 to a body of water via the gearcase cavity 28, or via an idle relief assembly 40 to an area outside the engine compartment (i.e., the atmosphere). The idle relief assembly 40 comprises an intermediate exhaust conduit 42 coupled to the primary exhaust passageway 16 between the upstream end 36 and the downstream end 38, which is configured to receive the exhaust gas from the primary exhaust passageway 16. A primary muffler 44 receives the exhaust gas from the intermediate exhaust conduit 42. A secondary muffler 46 receives the exhaust gas from the primary muffler 44 via the intermediate exhaust conduit 42. The intermediate exhaust conduit 42 has an upstream end 48 that provides the exhaust gas to the primary muffler 44 and a first downstream end 50 that discharges the exhaust gas to the secondary muffler 46. The exhaust system 13 also includes an idle relief outlet 52 that discharges the exhaust gas from the secondary muffler 46 (by way of further downstream end 66 of intermediate exhaust conduit 42) to the area outside the engine compartment (i.e., the atmosphere). The idle relief outlet 52 is configured to be located above the body of water in which the marine propulsion device is operated, at least when the marine propulsion device's engine is operated at an idle speed.

In this example, the sound enhancement assembly 18 communicates with the primary exhaust passageway 16 via the idle relief assembly 40. More specifically, the primary muffler 44 has an inlet 54 coupled to the primary exhaust passageway 16 by way of upstream end 48 of intermediate exhaust conduit 42. The sound enhancement assembly 18 is connected to the primary muffler 44 via the sound control valve 24, and the sound control valve 24 controls provision of the exhaust gas from the primary muffler 44 to the sound enhancement assembly 18. The intermediate exhaust conduit 42 is also coupled to an outlet 56 of the primary muffler 44 and includes a second downstream end 60 that leads to the idle relief outlet 52 configured to discharge the exhaust gas to the area outside the engine compartment. An idle relief control valve 58 controls flow of the exhaust gas from the muffler outlet 56 through the second downstream end 60 of the intermediate exhaust conduit 42 to the idle relief outlet 52.

The idle relief control valve 58 is coupled to and/or positioned in the intermediate exhaust conduit 42 and is positionable into an open position, shown in FIG. 6, wherein the exhaust gas is permitted to bypass the secondary muffler 46 and flow from the primary muffler 44 to the idle relief outlet 52. The intermediate exhaust conduit 42 has the second downstream end 60 that discharges the exhaust gas to the idle relief outlet 52 when the idle relief control valve 58 is in the noted open position. The idle relief control valve 58 is further positionable into a closed position, shown in FIG. 5, wherein the exhaust gas is not permitted to bypass the secondary muffler 46 via the second downstream end 60. Instead, the exhaust gas flows from the primary muffler 44 to the idle relief outlet 52 via the first downstream end 50 of the intermediate exhaust conduit 42, the secondary muffler 46, and the further downstream end 66 of the intermediate exhaust conduit 42.

In certain examples, the idle relief control valve 58 is also positionable into one or more intermediate position(s) wherein, compared to the open position, at an idle speed of the internal combustion engine, a reduced amount of exhaust gas is permitted to bypass the secondary muffler 46 and flow from the primary muffler 44 to the idle relief outlet 52. In other words, at an idle speed of the internal combustion engine, in the intermediate position(s), a portion of the exhaust gas is permitted to bypass the secondary muffler 46 and a portion of the exhaust gas is forced to flow through the secondary muffler 46. Both portions are discharged via the idle relief outlet 52. In certain examples, the idle relief control valve 58 is located at the second downstream end 60 of the intermediate exhaust conduit 42 at a location that is on an opposite side of an adapter plate 62 of the marine propulsion device relative to the primary and secondary mufflers 44, 46, although such positioning is not shown herein.

When the idle relief control valve 58 is in the closed position, the exhaust system 13 forms a dual muffler circuit, and when the idle relief control valve 58 is in the open position, the exhaust system 13 forms a single muffler circuit. The exhaust system 13 operates in a "quiet mode" when the idle relief control valve 58 is in the closed position and the exhaust gas is routed through the more restrictive dual muffler circuit. The exhaust system 13 operates in a relatively louder "sport mode" when the idle relief control valve 58 is in the open position and the exhaust gas is routed through the less restrictive single muffler circuit.

Note that the idle relief control valve 58 can also be controlled by an operator input device, which can be the same as or distinct from the operator input device 31 described with respect to FIG. 2. It should be understood that the sound control valve 24 and the idle relief control value 58 can be controlled simultaneously and by way of the same operator input device 31, such that the idle relief control valve 58 is simultaneously operated to the same open, intermediate, or closed position as is the sound control valve 24. Alternatively, separate operator input devices can be provided for each of the idle relief control valve 58 and the sound control valve 24, or a button or switch can be provided that allows the operator to select between controlling the position of the idle relief control valve 58 or the position of the sound control valve 24 with the operator input device. In yet other examples, the sound control valve 24 can be automatically controlled by the controller 35 based on engine or vessel speed, as described herein above, while the idle relief control valve 58 is controlled by way of the operator input device. By way of the above-described arrangements in which position of the sound control valve 24 is independent of position of the idle relief control valve 58, the primary exhaust path may still be through the gearcase cavity 28 and propeller assembly, while amplified exhaust sounds are provided via the sound enhancement assembly 18. (This is also the case for the arrangement of FIG. 2, in which no idle relief control valve is provided.)

FIGS. 7 and 8 show yet another example of an exhaust system 15 according to the present disclosure. Many of the components are the same as those described with respect to FIGS. 5 and 6, and these will not be described again. Note that in this example, however, the placement of the sound enhancement assembly 18 has changed. The sound enhancement assembly 18, including the drive pipe 26, sound enhancement device 20, and sound duct 22, is now located just below the adapter plate 62. Instead of having a separate sound control valve 24 and idle relief control valve 58 as in the example of FIGS. 5 and 6, the sound control valve is a combined sound and idle relief control valve 64 controlling flow of the exhaust gas from the muffler outlet 56 through the second downstream end 60 of the intermediate exhaust conduit 42 to the idle relief outlet 52. The sound enhancement assembly 18 is connected to the intermediate exhaust conduit 42 downstream of the combined sound and idle relief control valve 64.

Placement of the sound enhancement assembly 18 in this location means that the combined sound and idle relief control valve 64 controls not only the release of air through the idle relief assembly 40 in the "quiet mode" or the "sport mode", but also controls the sound pressure level entering the sound enhancement assembly 18 at the same time. When the combined sound and idle relief control valve 64 is closed, as shown in FIG. 7, the exhaust system 15 is operated in the "quiet mode", and exhaust flows through both the primary muffler 44 and the secondary muffler 46. The output from the sound enhancement assembly 18 is less when the combined sound and idle relief control valve 64 is closed than when it is open because the sound pressure level entering the drive pipe 26 has been attenuated by both the primary muffler 44 and the secondary muffler 46.

In contrast, when the combined sound and idle relief control valve 64 is open, as shown in FIG. 8, the exhaust system 15 is in the "sport mode" and exhaust gas travels through the primary muffler 44, through the muffler outlet 56, through the open combined sound and idle relief control valve 64, and through the second downstream end 60 of the intermediate exhaust conduit 42 to the idle relief outlet 52. Exhaust gas of a higher sound pressure level, which was attenuated only by the primary muffler 44, is thus also provided to the drive pipe 26 of the sound enhancement assembly 18, which thereafter modifies exhaust sounds as described hereinabove. Thus, in contrast to the example of FIGS. 5 and 6, a single operator input device 31 and/or signal from the controller 35 will control both the idle relief pathway and the amplification of exhaust sounds by way of changing a position of the valve plate in the combined sound and idle relief control valve 64.

Figure 9:
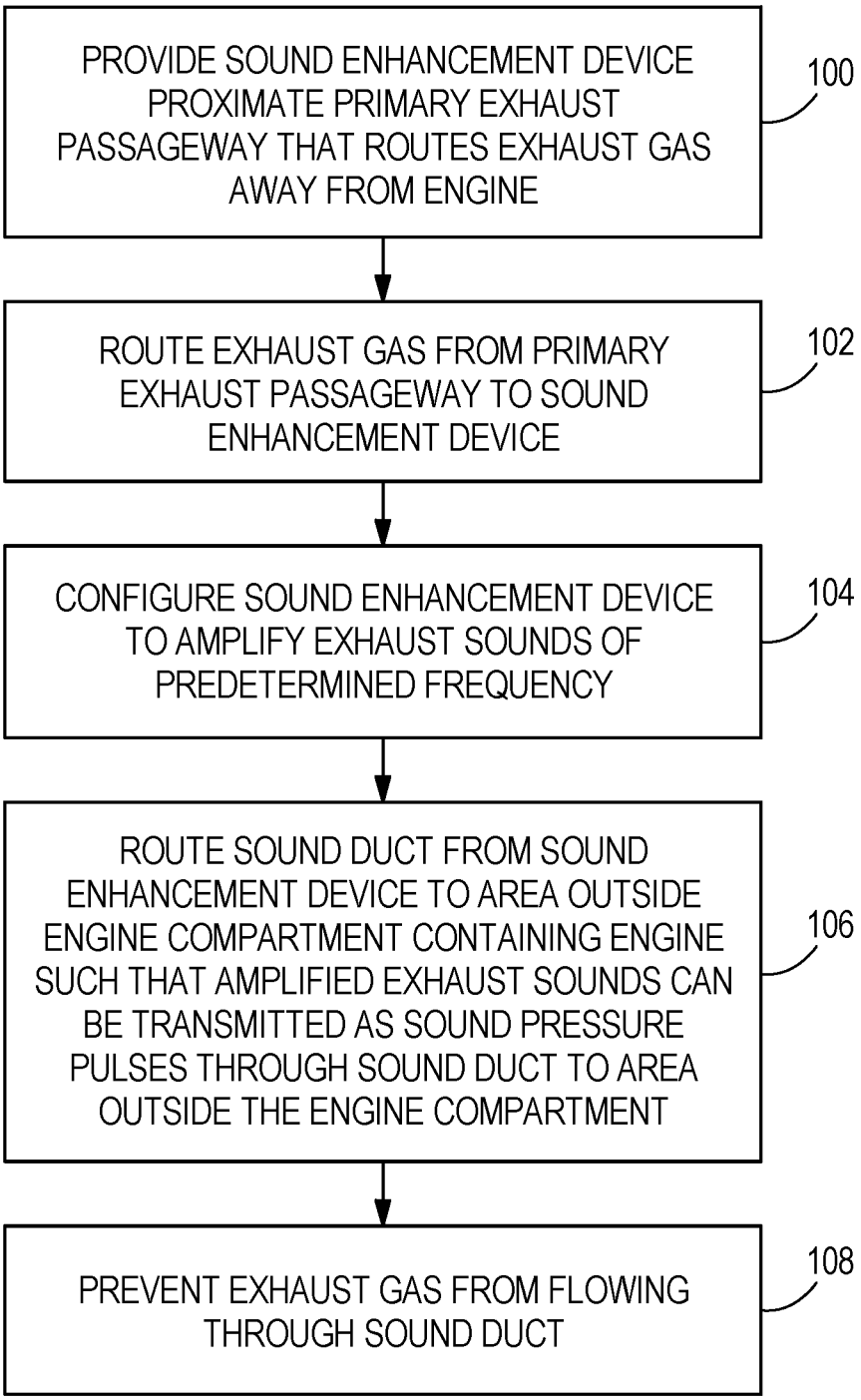
FIG. 9 shows a method for modifying sounds produced by an exhaust system of an internal combustion engine powering a marine propulsion device.

FIG. 9 shows a method for modifying sounds produced by an exhaust system 9, 11, 13, 15 of an internal combustion engine 12 powering a marine propulsion device 10. As shown at box 100, the method comprises providing a sound enhancement device 20 proximate a primary exhaust passageway 16 that routes exhaust gas away from the engine 12. As shown at 102, the method includes routing the exhaust gas from the primary exhaust passageway 16 to the sound enhancement device 20. This may include routing the exhaust gas to the sound enhancement device 20 from a portion 16*a* of the primary exhaust passageway 16 that carries exhaust gas that has been cooled by cooling water. With reference to FIG. 4, providing the sound enhancement device 20 may include providing a membrane housing 20*a* having an open interior 20*b* and coupling an inlet 20*d* of the membrane housing 20*a* to the primary exhaust passageway 16, and providing a flexible membrane 20*c* transversely across the open interior 20*b* of the membrane housing 20*a*. The method may further comprise coupling the sound duct 22 to an outlet 20*e* of the membrane housing 20*a*, the membrane housing outlet 20*e* being on an opposite side of the flexible membrane 20*c* than the membrane housing inlet 20*d*.

As shown at box 104, the method includes configuring the sound enhancement device 20 to amplify exhaust sounds of a predetermined frequency. This may include any or all of configuring the size, shape, and/or mechanical properties of the sound enhancement device 20, as described hereinabove. The method also includes routing a sound duct 22 from the sound enhancement device 20 to an area outside an engine compartment 14 containing the engine 12 such that the amplified exhaust sounds can be transmitted as sound pressure pulses through the sound duct 22 to the area outside the engine compartment 14, as shown at box 106. As shown at box 108, the method also includes preventing the exhaust gas from flowing through the sound duct 22. This can be done by way of, for example, ensuring that the membrane 20*c* provides a fluid-tight seal across the open interior 20*b* of the membrane housing 20*a*.

The method may also include providing an idle relief assembly 40 in communication with the primary exhaust passageway 16, wherein the idle relief assembly 40 routes the exhaust gas from the primary exhaust passageway 16 to the sound enhancement device 20. The idle relief assembly 40 may comprise a muffler 44 having an inlet 54 coupled to the primary exhaust passageway 16, and the sound control valve 24 may control provision of the exhaust sounds from the muffler 44 to the sound enhancement device 20. The idle relief assembly 40 may further comprise an intermediate exhaust conduit 42 coupled to an outlet 56 of the muffler 44 and leading to an idle relief outlet 52 configured to discharge the exhaust gas to the area outside the engine compartment 14.

The method may also include selecting a level of amplification of the exhaust sounds by way of providing a sound control valve 24, 64 upstream of the sound enhancement device 20 that controls provision of the exhaust gas to the sound enhancement device 20. An operator input device 31 can be provided via which an operator can control the sound control valve 24, 64. In one example, the sound control valve is a combined sound and idle relief control valve 64 that controls flow of the exhaust gas from the muffler 44 through the intermediate exhaust conduit 42 to the idle relief outlet 52, and the method further comprises connecting the sound enhancement device 20 to the intermediate exhaust conduit 42 downstream of the combined sound and idle relief control valve 64. See FIGS. 7 and 8. In another example, the method comprises providing a separate idle relief control valve 58 configured to control flow of the exhaust gas from the muffler outlet 56 through the intermediate exhaust conduit 42 to the idle relief outlet 52 and connecting the sound enhancement device 20 to the muffler 44 via the sound control valve 24. See FIGS. 5 and 6.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A marine propulsion device comprising:

an internal combustion engine powering the marine propulsion device;

an engine compartment containing the engine;

a primary exhaust passageway routing exhaust gas away from the engine and out of the engine compartment and through at least one of an underwater outlet and an idle relief outlet; and a sound enhancement assembly communicating with the primary exhaust passageway, the sound enhancement assembly including:

a sound enhancement device tuned to amplify exhaust sounds of a predetermined frequency; and a sound duct downstream of the sound enhancement device that transmits the amplified exhaust sounds to an area outside the engine compartment, wherein the sound enhancement device isolates the sound duct from the exhaust gas, such that the sound duct does not supply the exhaust gas to the area outside the engine compartment.

2. The marine propulsion device of claim 1, further comprising a sound control valve upstream of the sound enhancement device that controls provision of the exhaust gas to the sound enhancement device.

3. The marine propulsion device of claim 2, further comprising an operator input device via which an operator can control the sound control valve.

4. The marine propulsion device of claim 2, further comprising an idle relief assembly communicating with the primary exhaust passageway, wherein the sound enhancement assembly communicates with the primary exhaust passageway via the idle relief assembly.

5. The marine propulsion device of claim 4, wherein the idle relief assembly comprises a muffler having an inlet coupled to the primary exhaust passageway, and wherein the sound control valve controls provision of the exhaust gas from the muffler to the sound enhancement assembly.

6. The marine propulsion device of claim 5, wherein the idle relief assembly further comprises an intermediate exhaust conduit coupled to an outlet of the muffler and leading to the idle relief outlet, which is configured to discharge the exhaust gas to the area outside the engine compartment.

7. The marine propulsion device of claim 6, further comprising an idle relief control valve controlling flow of the exhaust gas from the muffler outlet through the intermediate exhaust conduit to the idle relief outlet;

wherein the sound enhancement assembly is connected to the muffler via the sound control valve.

8. The marine propulsion device of claim 6, wherein the sound control valve is a combined sound and idle relief control valve controlling flow of the exhaust gas from the muffler outlet through the intermediate exhaust conduit to the idle relief outlet; and wherein the sound enhancement assembly is connected to the intermediate exhaust conduit downstream of the combined sound and idle relief control valve.

9. The marine propulsion device of claim 1, wherein the sound enhancement assembly communicates with a portion of the primary exhaust passageway that carries exhaust gas that has been cooled by cooling water.

10. The marine propulsion device of claim 1, wherein the sound enhancement device comprises:

a membrane housing coupling the sound duct to the primary exhaust passageway, the membrane housing having an open interior; and a flexible membrane extending transversely across the open interior of the membrane housing and isolating the sound duct from the exhaust gas.

11. A method for modifying sounds produced by an exhaust system of an internal combustion engine powering a marine propulsion device, the method comprising:

providing a sound enhancement device proximate a primary exhaust passageway that routes exhaust gas away from the engine;

routing the exhaust gas from the primary exhaust passageway to the sound enhancement device;

providing an idle relief assembly in communication with the primary exhaust passageway, wherein the idle relief assembly routes the exhaust gas from the primary exhaust passageway to the sound enhancement device;

configuring the sound enhancement device to amplify exhaust sounds of a predetermined frequency;

routing a sound duct from the sound enhancement device to an area outside an engine compartment containing the engine such that the amplified exhaust sounds can be transmitted as sound pressure pulses through the sound duct to the area outside the engine compartment; and preventing the exhaust gas from flowing through the sound duct.

12. The method of claim 11, further comprising routing the exhaust gas to the sound enhancement device from a portion of the primary exhaust passageway that carries exhaust gas that has been cooled by cooling water.

13. The method of claim 12, wherein providing the sound enhancement device comprises:

providing a membrane housing having an open interior and coupling an inlet of the membrane housing to the primary exhaust passageway; and providing a flexible membrane transversely across the open interior of the membrane housing;

the method further comprising coupling the sound duct to an outlet of the membrane housing, the membrane housing outlet being on an opposite side of the flexible membrane than the membrane housing inlet.

14. The method of claim 13, further comprising providing a sound control valve upstream of the sound enhancement device that controls provision of the exhaust gas to the sound enhancement device.

15. The method of claim 14, further comprising providing an operator input device via which an operator can control the sound control valve.

16. The method of claim 11, wherein the idle relief assembly comprises a muffler having an inlet coupled to the primary exhaust passageway, and further comprising providing a sound control valve upstream of the sound enhancement device that controls provision of the exhaust gas from the muffler to the sound enhancement device.

17. The method of claim 16, wherein the idle relief assembly further comprises an intermediate exhaust conduit coupled to an outlet of the muffler and leading to an idle relief outlet configured to discharge the exhaust gas to the area outside the engine compartment.

18. The method of claim 17, further comprising:

providing an idle relief control valve configured to control flow of the exhaust gas from the muffler outlet through the intermediate exhaust conduit to the idle relief outlet; and connecting the sound enhancement device to the muffler via the sound control valve.

19. The method of claim 17, wherein the sound control valve is a combined sound and idle relief control valve controlling flow of the exhaust gas from the muffler outlet through the intermediate exhaust conduit to the idle relief outlet;

the method further comprising connecting the sound enhancement device to the intermediate exhaust conduit downstream of the combined sound and idle relief control valve.

20. A marine propulsion device comprising:

an internal combustion engine powering the marine propulsion device;

an engine compartment containing the engine;

a primary exhaust passageway routing exhaust gas away from the engine and out of the engine compartment;

a sound enhancement assembly communicating with the primary exhaust passageway, the sound enhancement assembly including:

a sound enhancement device tuned to amplify exhaust sounds of a predetermined frequency; and a sound duct downstream of the sound enhancement device that transmits the amplified exhaust sounds to an area outside the engine compartment, wherein the sound enhancement device isolates the sound duct from the exhaust gas; and an idle relief assembly communicating with the primary exhaust passageway, wherein the sound enhancement assembly communicates with the primary exhaust passageway via the idle relief assembly.

* * * * *